US008851586B1

(12) United States Patent
Huang

(10) Patent No.: US 8,851,586 B1
(45) Date of Patent: Oct. 7, 2014

(54) AUTOMATIC FULL-OPEN TYPE SLIDING BOX MOUNTING STRUCTURE

(71) Applicant: Nan Juen International Co., Ltd., New Taipei (TW)

(72) Inventor: Kuo-Sheng Huang, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 0 days.

(21) Appl. No.: 14/013,945

(22) Filed: Aug. 29, 2013

(51) Int. Cl.
*A47B 95/00* (2006.01)
*A47B 88/00* (2006.01)
*A47B 95/02* (2006.01)

(52) U.S. Cl.
USPC ..... 312/333; 312/334.47; 312/319.1

(58) Field of Classification Search
CPC ..... A47B 88/08; A47B 88/10; A47B 88/12; A47B 88/14; A47B 88/047; A47B 88/0477; A47B 88/0481; A47B 2210/0072; A47B 2210/0075
USPC ..... 312/333, 334.44, 334.45, 334.46, 312/334.47, 334.27, 334.6, 334.1, 319.1; 384/21
See application file for complete search history.

(56) References Cited

U.S. PATENT DOCUMENTS

| | | | | |
|---|---|---|---|---|
| 3,687,505 | A * | 8/1972 | Fall et al. | 384/18 |
| 5,492,400 | A * | 2/1996 | Rock | 312/331 |
| 7,374,261 | B1 * | 5/2008 | Wang | 312/333 |
| 7,393,068 | B2 * | 7/2008 | Sato et al. | 312/333 |
| 7,802,856 | B2 * | 9/2010 | Hashemi et al. | 312/334.46 |
| 8,100,487 | B2 * | 1/2012 | Liang et al. | 312/333 |
| 8,109,582 | B2 * | 2/2012 | Dubach | 312/319.1 |
| 8,172,345 | B2 * | 5/2012 | Liang et al. | 312/333 |
| 8,235,478 | B2 * | 8/2012 | Zimmer et al. | 312/333 |
| 2011/0007988 | A1 * | 1/2011 | Huang | 384/20 |
| 2011/0235952 | A1 * | 9/2011 | Chen et al. | 384/7 |
| 2013/0004101 | A1 * | 1/2013 | Chen et al. | 384/10 |
| 2013/0187524 | A1 * | 7/2013 | Chen | 312/319.1 |

FOREIGN PATENT DOCUMENTS

TW M428713 U1 * 5/2012 ..... A47B 88/04

* cited by examiner

*Primary Examiner* — Janet M Wilkens
*Assistant Examiner* — Andrew Roersma

(57) ABSTRACT

An automatic full-open type sliding box mounting structure includes a sliding box, a sliding track assembly mounted at the bottom side of the sliding box, and a first opening and closing device and a second opening and closing device and a reset device mounted at the top side of the sliding box in such a manner that the first opening and closing device and the second opening and closing device are capable of automatically moving the sliding box to the full-open position and, the reset device is capable of reset the first opening and closing device and the second opening and closing device when the user pushes the sliding box back to the close position for a next sliding box opening operation.

9 Claims, 19 Drawing Sheets

AUTOMATIC FULL-OPEN TYPE SLIDING BOX MOUNTING STRUCTURE

BACKGROUND OF THE INVENTION

1. Field of the Invention

The present invention relates to sliding rail assembly mounting technology, and more particularly to an automatic full-open type sliding box for use in a furniture for enabling a sliding box to be fully and automatically opened.

2. Description of the Related Art

Sliding track assemblies are widely used with sliding boxes in storage cabinets for storing things. These sliding track assemblies commonly use slidably coupled rails to support a sliding box in a cabinet for enabling the sliding box to be moved in and out of the cabinet, and elastic means for automatically pushing the sliding box out of the cabinet after having been released from the constrain. However, the functioning of the elastic means can simply push the sliding box out of the cabinet, it cannot push the sliding box to the full open position.

SUMMARY OF THE INVENTION

The present invention has been accomplished under the circumstances in view. It is the main object of the present invention to provide an automatic full-open type sliding box mounting structure, which enables the user to automatically open the sliding box to the fully opened status simply by pressing the sliding box with less effort, facilitating use.

To achieve this and other objects of the preset invention, an automatic full-open type sliding box mounting structure of the invention comprises a sliding track assembly, a first opening and closing device, a second opening and closing device, and a reset device. The sliding track assembly is mounted at the bottom side of the sliding box, comprising a first track member and a second track member. The second track member is slidably coupled to the bottom side of the first track member. The first track member has a stop block located at one end thereof. The second track member defines a retaining hole adjacent to the stop block. The first opening and closing device comprises a first sliding member, a stop member connected to one end of the first sliding member for engaging the stop block, and a first elastic member having one end thereof connected to one end of the first sliding member remote from the stop member and an opposite end thereof connected to the second track member. The second opening and closing device comprises a second sliding member slidably coupled to one lateral side of the second sliding member and engageable into the retaining hole of the second track member, and a second elastic member having one end thereof connected to one end of the second sliding member and an opposite end thereof connected to the second track member. The reset device comprises a first push member, a second push member, a first transmission wheel, a second transmission wheel, a third transmission wheel, a first transmission belt, and a second transmission belt. The first transmission wheel is pivotally mounted at one end of the second track member. The second transmission wheel and the third transmission wheel are pivotally mounted at an opposite end of the second track member remote from the first transmission wheel. The first transmission belt is mounted around the first endless groove of the first transmission wheel and the second transmission wheel. The second transmission belt is mounted around the second endless groove of the first transmission wheel and the third transmission wheel.

DETAILED DESCRIPTION OF THE PREFERRED EMBODIMENT

Figure 1:
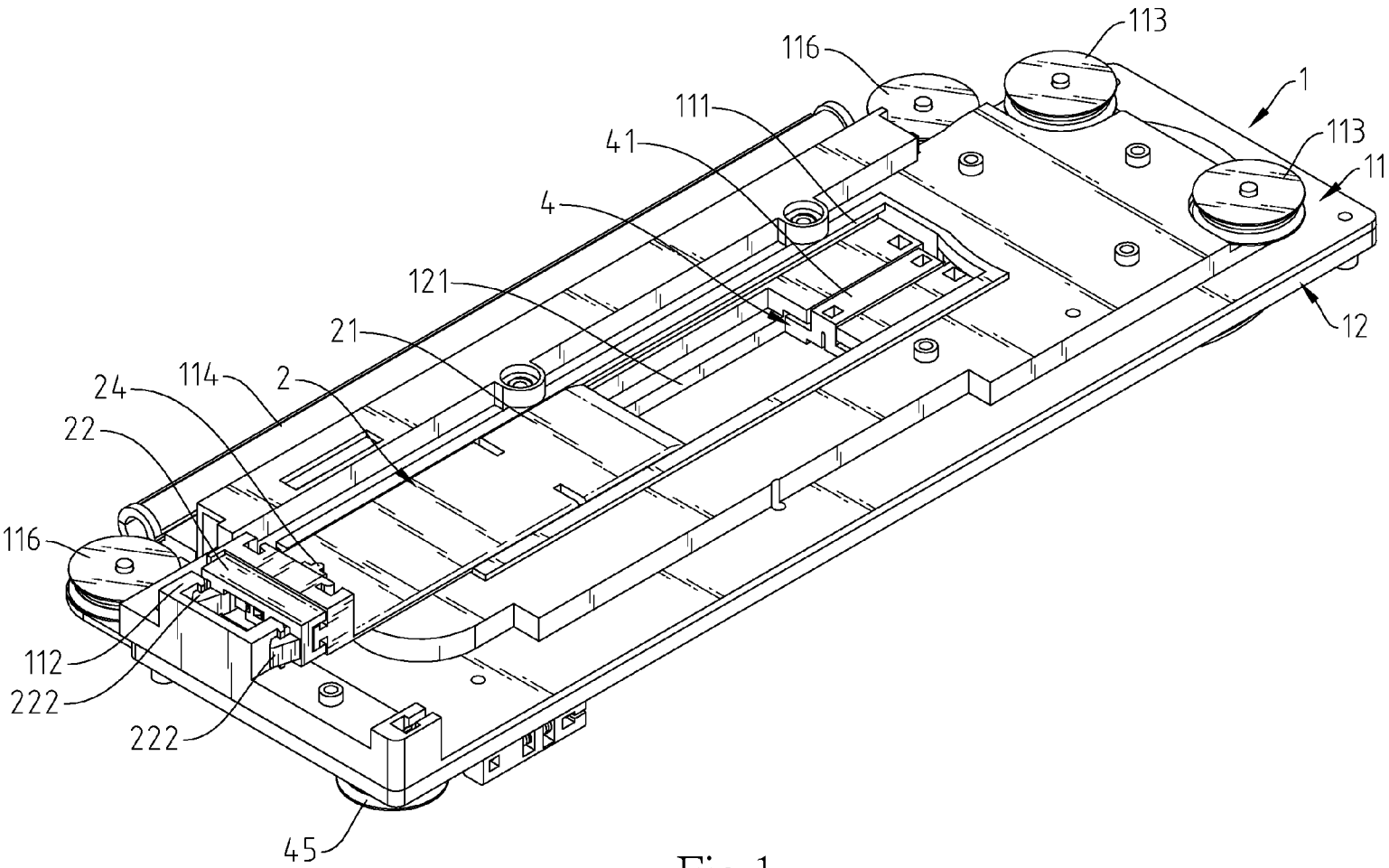
FIG. 1 is a partial elevational view of an automatic full-open type sliding box mounting structure in accordance with the present invention.
Figure 2:
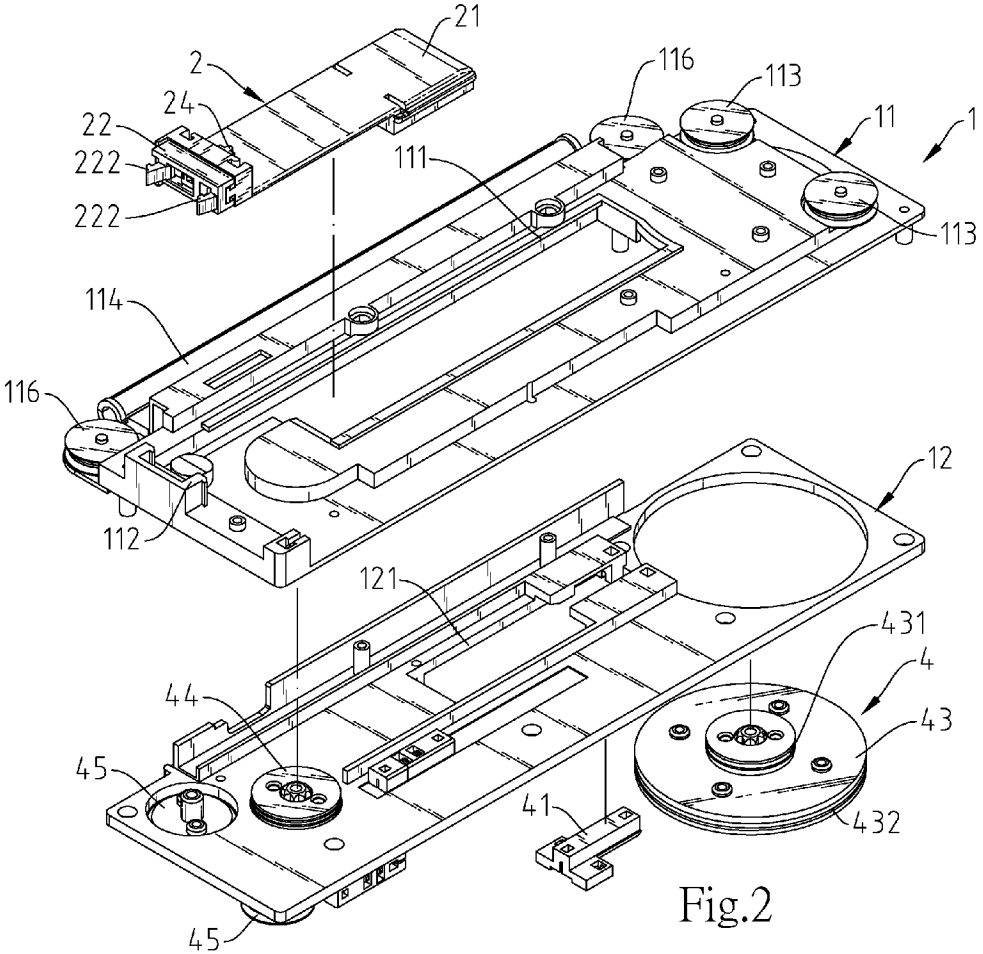
FIG. 2 is a partial exploded view of the automatic full-open type sliding box mounting structure in accordance with the present invention.
Figure 3:
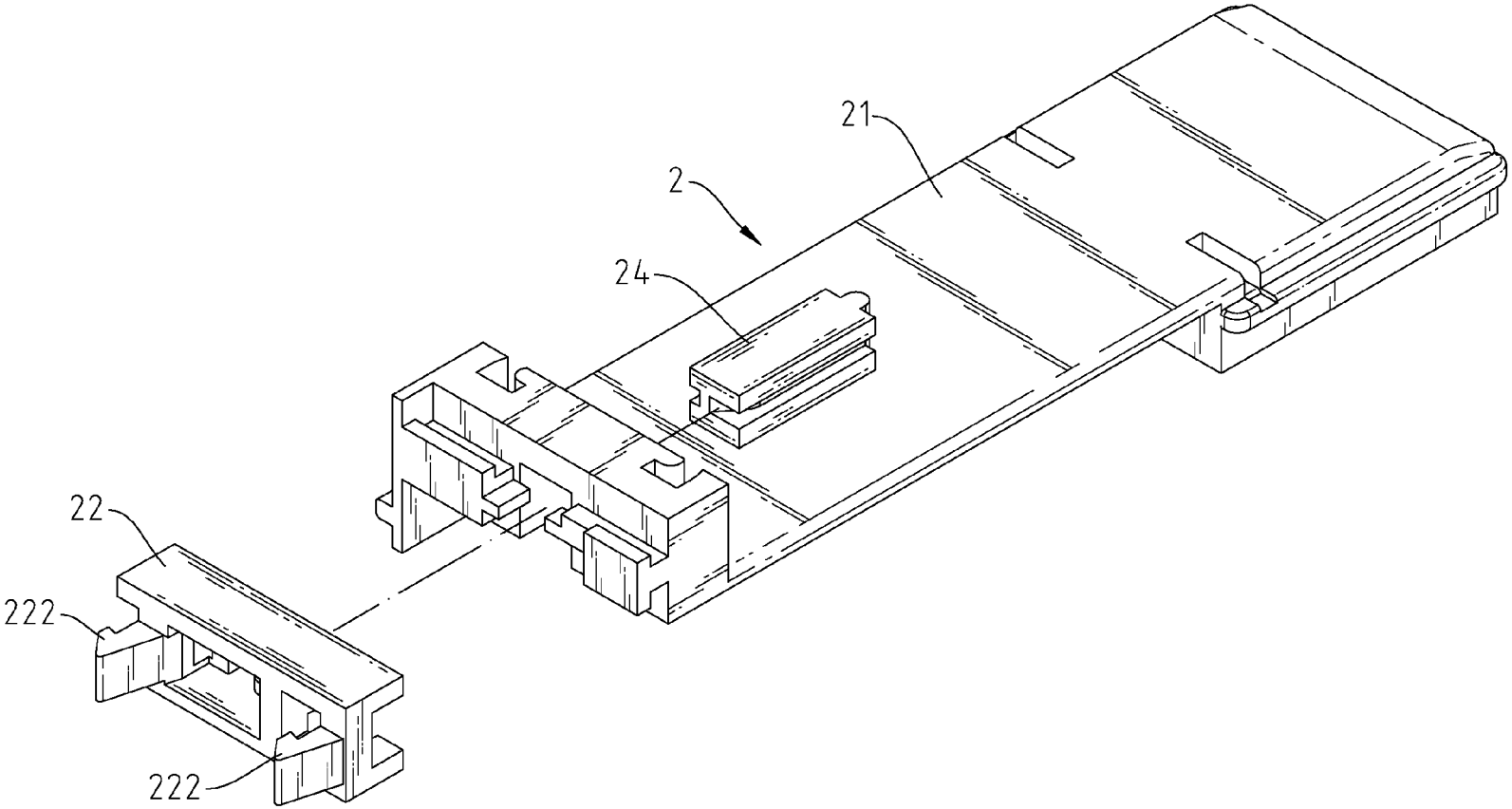
FIG. 3 is an exploded view of the first opening and closing device of the automatic full-open type sliding box mounting structure in accordance with the present invention.
Figure 4:
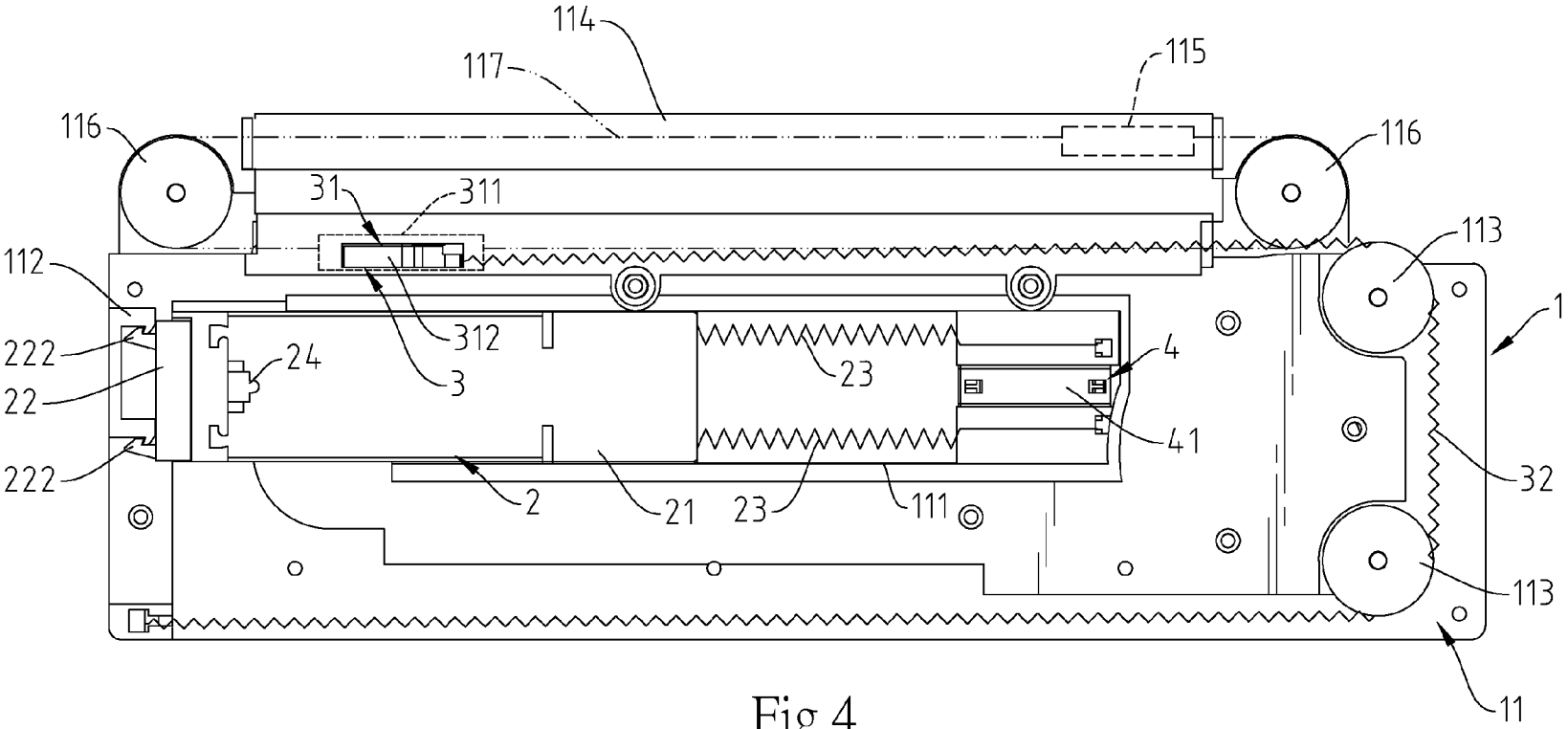
FIG. 4 is a schematic top view of the automatic full-open type sliding box mounting structure in accordance with the present invention.
Figure 5:
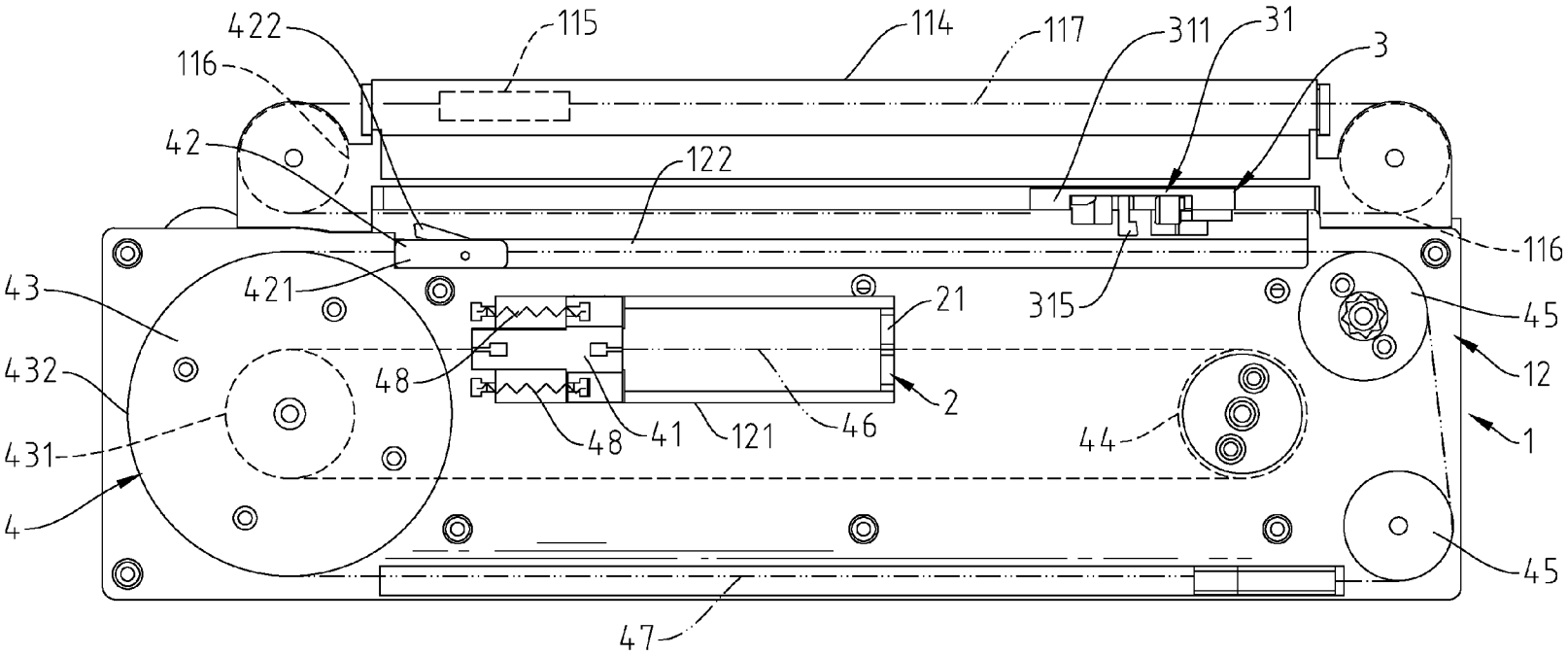
FIG. 5 is a schematic bottom view of the automatic full-open type sliding box mounting structure in accordance with the present invention.

Referring to FIGS. 1-7 and FIG. 10, an automatic full-open type sliding box mounting structure in accordance with the present invention is shown. The automatic full-open type sliding box mounting structure comprising a sliding track assembly 1, a first opening and closing device 2, a second opening and closing device 3, a reset device 4, and a sliding box 5.

The sliding track assembly 1 is mounted at a bottom side of the sliding box 5, comprising a first track member 11 and a second track member 12 coupled to a bottom side of the first track member 11. The first track member 11 comprises a first longitudinal sliding slot 111, a stop block 112 located at a front end thereof, a plurality of runners 113 pivotally mounted near a rear end thereof remote from the stop block 112, a damper 114 disposed at one lateral side thereof, a piston 115 mounted in the damper 114, two fourth transmission wheels 116 pivotally mounted at the same lateral side and respectively disposed adjacent to opposing ends of the damper 114, and a third transmission belt 117 mounted around the fourth transmission wheels 116 and connected with the piston 115. The second track member 12 comprises a second longitudinal sliding slot 121 corresponding to the first longitudinal sliding slot 111 of the first track member 11, a third longitudinal sliding slot 122 disposed at one lateral side relative to the second longitudinal sliding slot 121, and a retaining hole 123 disposed at one lateral side thereof adjacent to the stop block 112 of the first track member 11.

The first opening and closing device 2 comprises a first sliding member 21 slidably coupled to the first longitudinal sliding slot 111 of the first track member 11 and defining opposing front and rear ends, a stop member 22 connected to the front end of the first sliding member 21 and defining a middle stop rod 221 and two opposing lateral hook rods 222 for engagement with the stop block 112 of the first track member 11, a push block 24 supported on the first sliding member 21 and adapted to push the stop member 22, and a first elastic member 23 mounted at the rear end of the first sliding member 21 and connected to the second track member 12 for preserving elastic potential energy upon engagement between the stop member 22 and the stop block 112.

The second opening and closing device 3 comprises a second sliding member 31 coupled to one lateral side of the second track member 12 and fastened to the third transmission belt 117 and engageable into the retaining hole 123 of the second track member 12 and movable back and forth relative to the second track member 12 in the same sliding direction of the first sliding member 21, and a second elastic member 32 having its one end connected to one end of the second sliding member 31 and its other end extending mover the runners 113 and affixed to the second track member 12 for preserving elastic potential energy upon engagement between the second sliding member 31 and the retaining hole 123. The second sliding member 31 comprises a side frame 311 connected to the third transmission belt 117 and slidably coupled to one lateral side of the second track member 12, a pivot 312 mounted in the side frame 311, and a retaining plate 313 pivotally mounted at the pivot 312. The retaining plate 313 comprises a retaining notch 314 located at a bottom side thereof, and a protruding stop portion 315 disposed at one lateral side of the retaining notch 314 and positioned in the retaining hole 123 of the sliding track assembly 1. Further, the second elastic member 32 is connected to the retaining plate 313 opposite to the retaining notch 314.

The reset device 4 comprises a first push member 41 set in the second longitudinal sliding slot 121, a second push member 42 set in the third longitudinal sliding slot 122, a first transmission wheel 43, a second transmission wheel 44, a third transmission wheel 45, a first transmission belt 46, a second transmission belt 47, and a third elastic member 48. The first transmission wheel 43 comprises a first endless groove 431 and a second endless groove 432 disposed in a concentric manner. The diameter of the first endless groove 431 is smaller than the diameter of the second endless groove 432. The first transmission wheel 43 is pivotally mounted at the rear end of the second track member 12 adjacent to the second longitudinal sliding slot 121. The second transmission wheel 44 and the third transmission wheel 45 are pivotally mounted at the opposing front end of the second track member 12 and kept away from the second longitudinal sliding slot 121. The first transmission belt 46 is mounted around the first endless groove 431 of the first transmission wheel 43 and the second transmission wheel 44. The second transmission belt 47 is mounted around the second endless groove 432 of the first transmission wheel 43 and the third transmission wheel 45. The first push member 41 is connected to the first transmission belt 46. The second push member 42 is connected to the second transmission belt 47. Further, the third elastic member 48 has its two opposite ends respectively connected to the first push member 41 and the second longitudinal sliding slot 121. Further, the second push member 42 comprises a body 421, and an elastically retractable stop component 422 elastically movable in and out of the body 421.

The sliding box 5 is located at the top side of the sliding track assembly 1, comprising a press member 51 facing toward the push block 24 of the first opening and closing device 2, and a push rod 52 facing toward the second sliding member 31 of the second opening and closing device 3 and spaced from the press member 51 at a predetermined distance.

Figure 6:
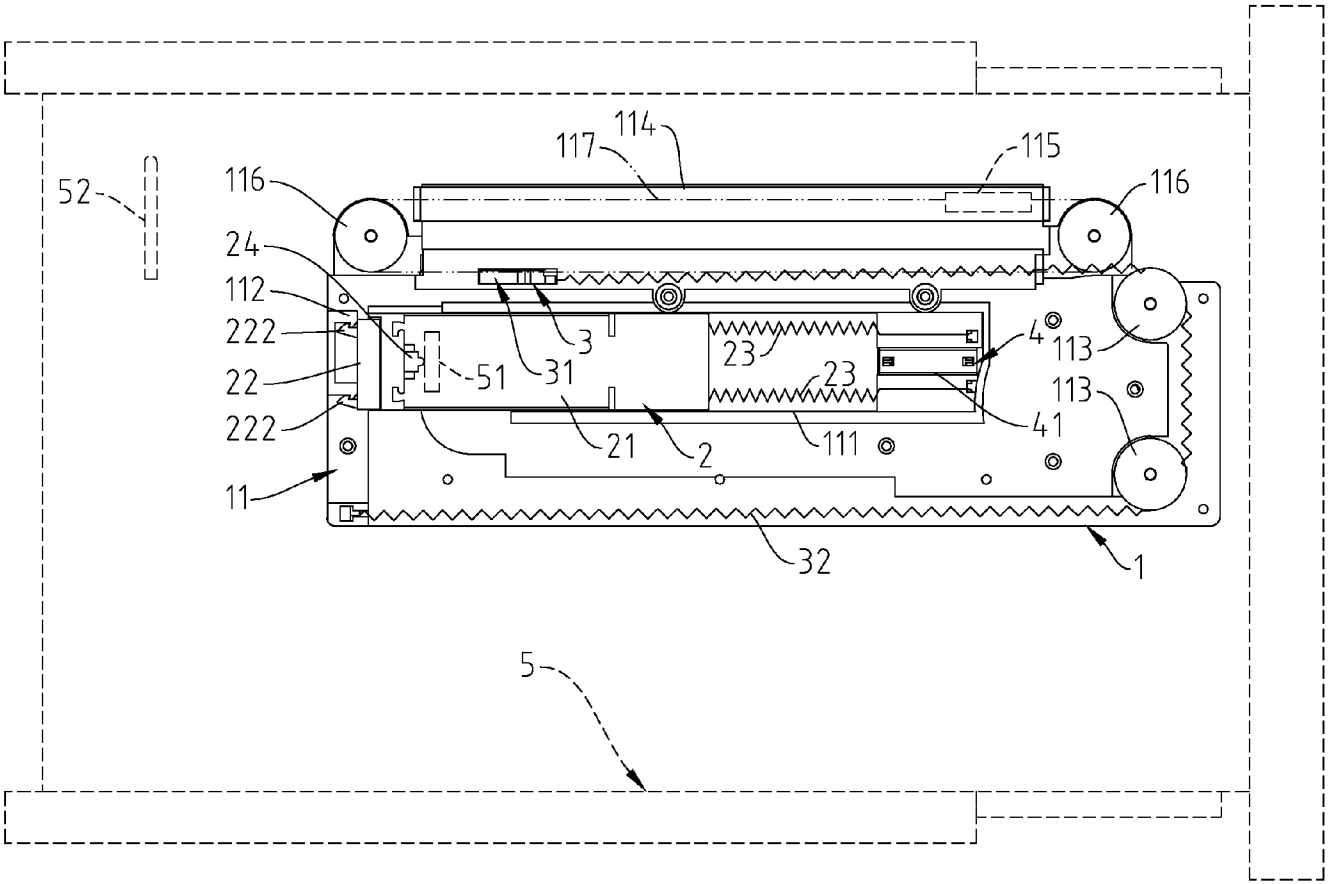
FIG. 6 is a schematic drawing of the present invention, illustrating the automatic full-open type sliding box mounting structure installed in the sliding box.
Figure 7:
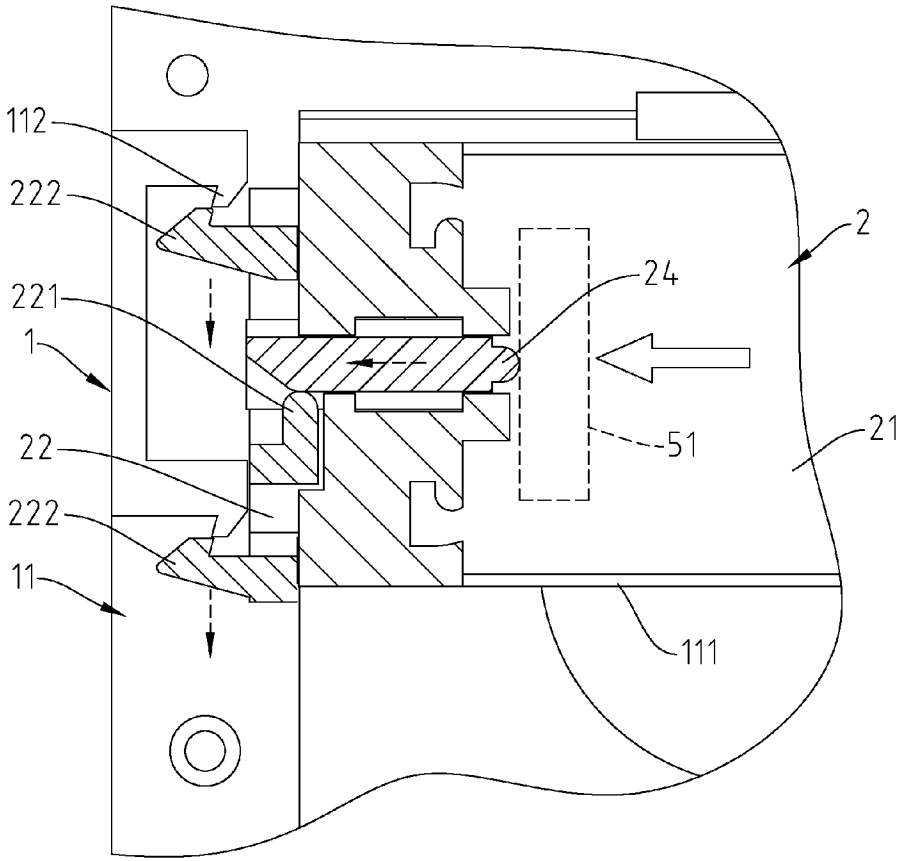
FIG. 7 is a schematic drawing illustrating an operation status of the automatic full-open type sliding box mounting structure in accordance with the present invention (I).
Figure 8:
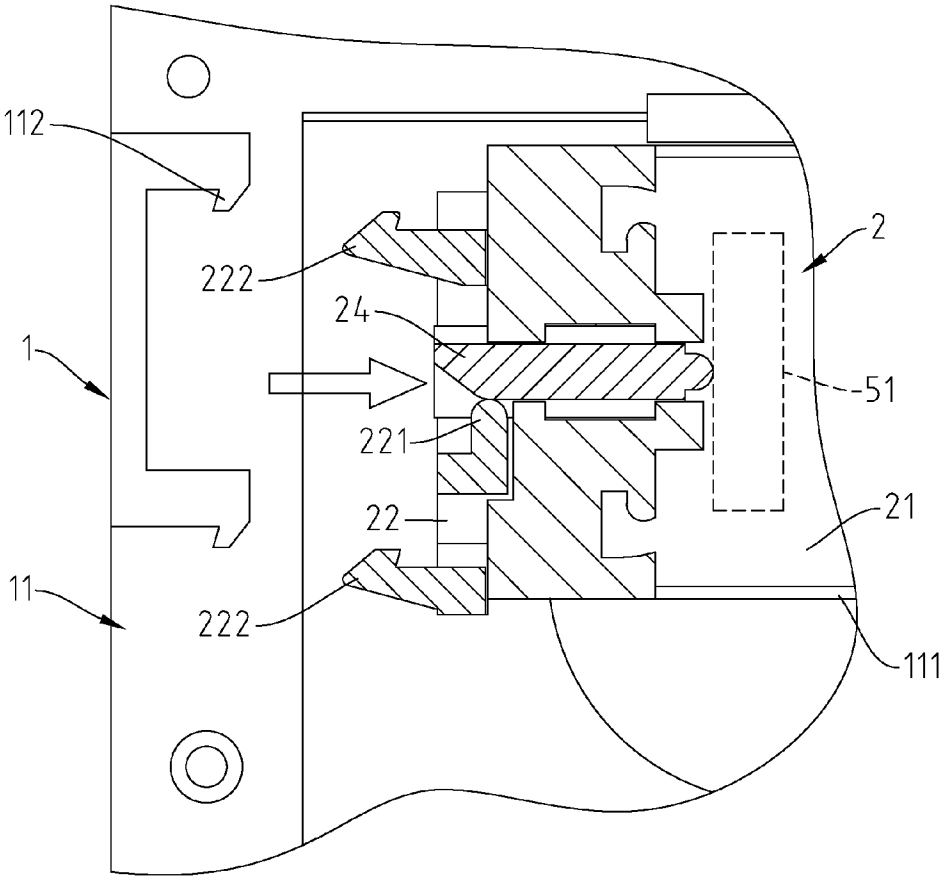
FIG. 8 is a schematic drawing illustrating an operation status of the automatic full-open type sliding box mounting structure in accordance with the present invention (II).
Figure 9:
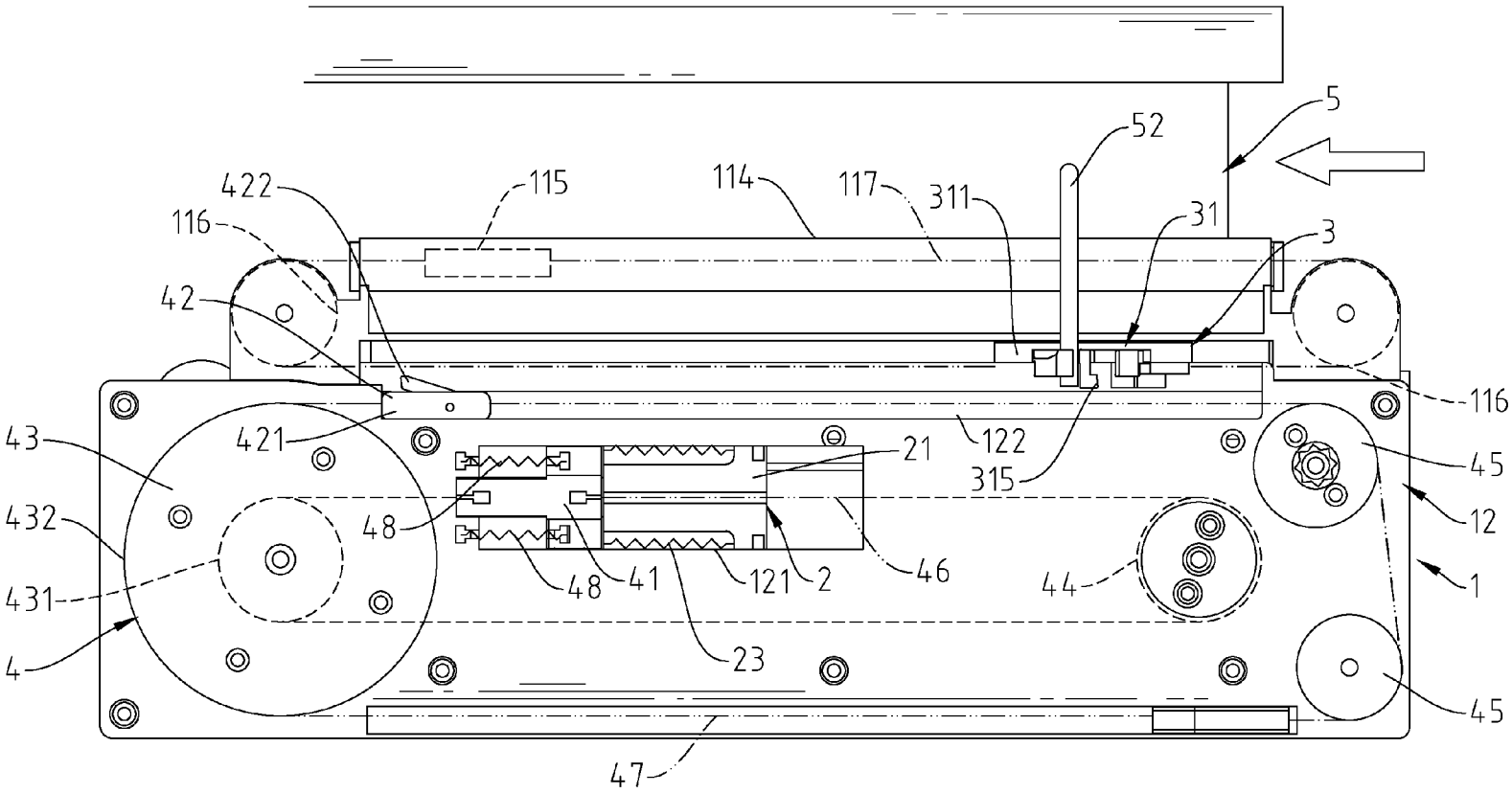
FIG. 9 is a schematic drawing illustrating an operation status of the automatic full-open type sliding box mounting structure in accordance with the present invention (III).
Figure 10:
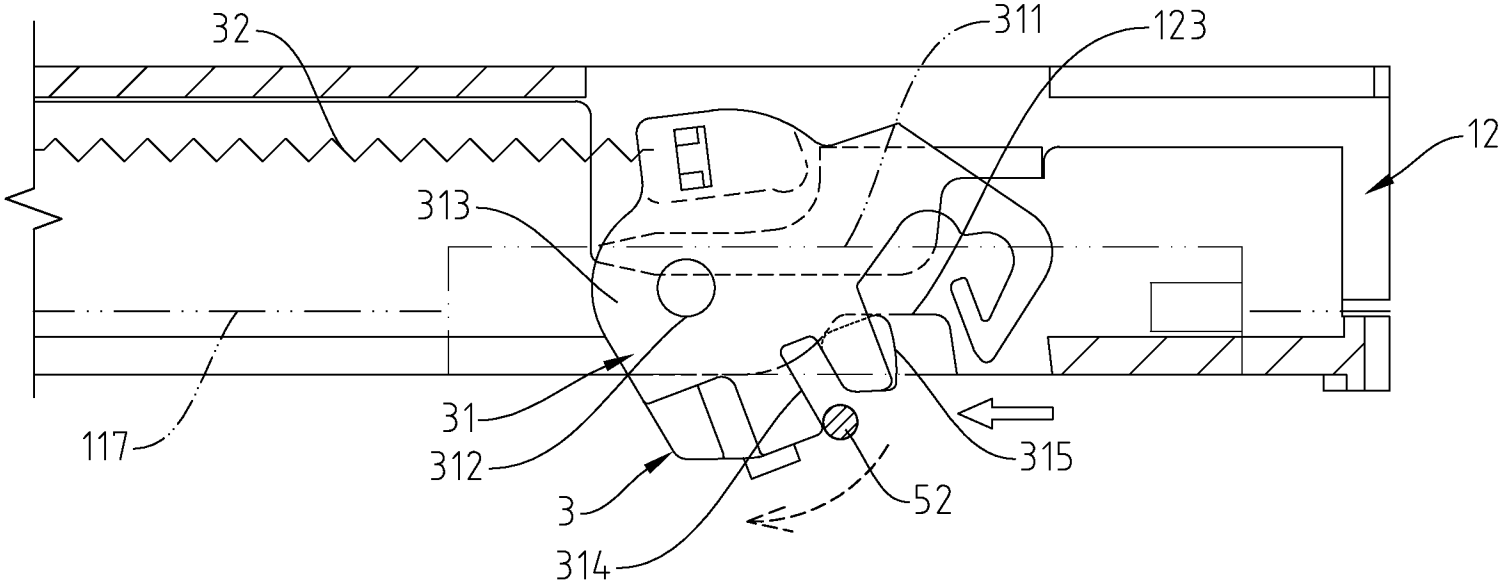
FIG. 10 is a schematic drawing illustrating an operation status of the automatic full-open type sliding box mounting structure in accordance with the present invention (IV).
Figure 11:
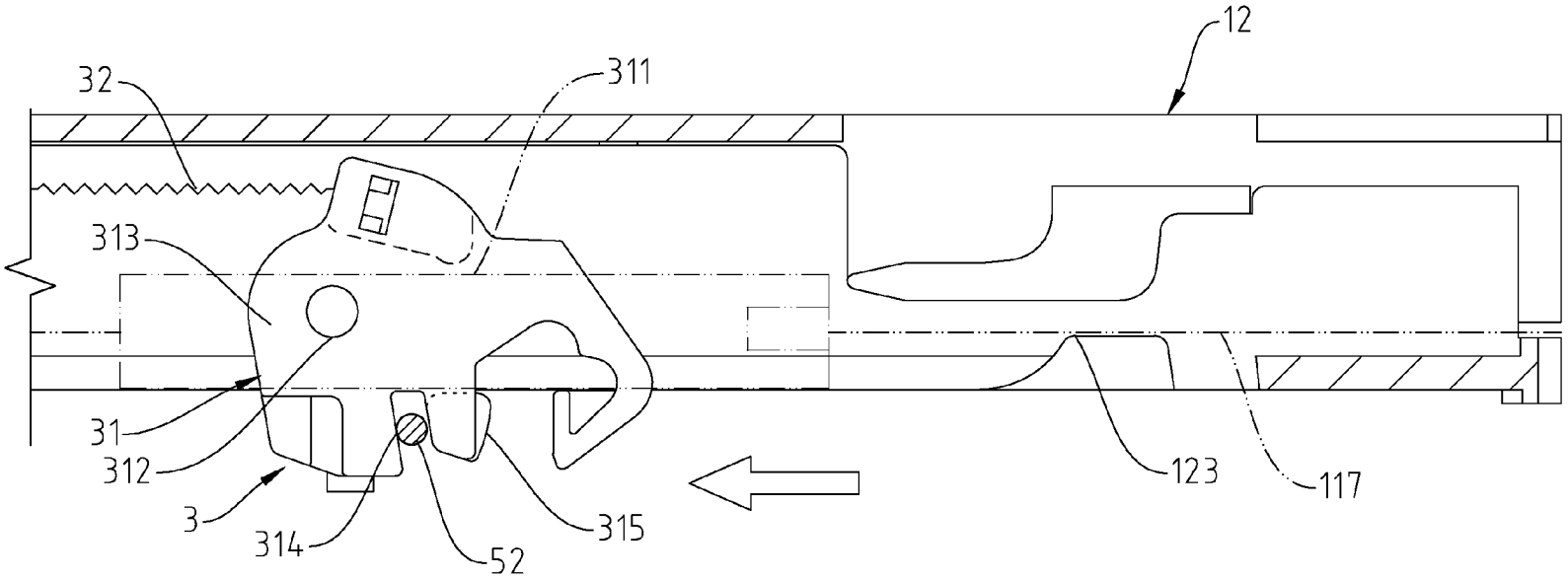
FIG. 11 is a schematic drawing illustrating an operation status of the automatic full-open type sliding box mounting structure in accordance with the present invention (V).
Figure 12:
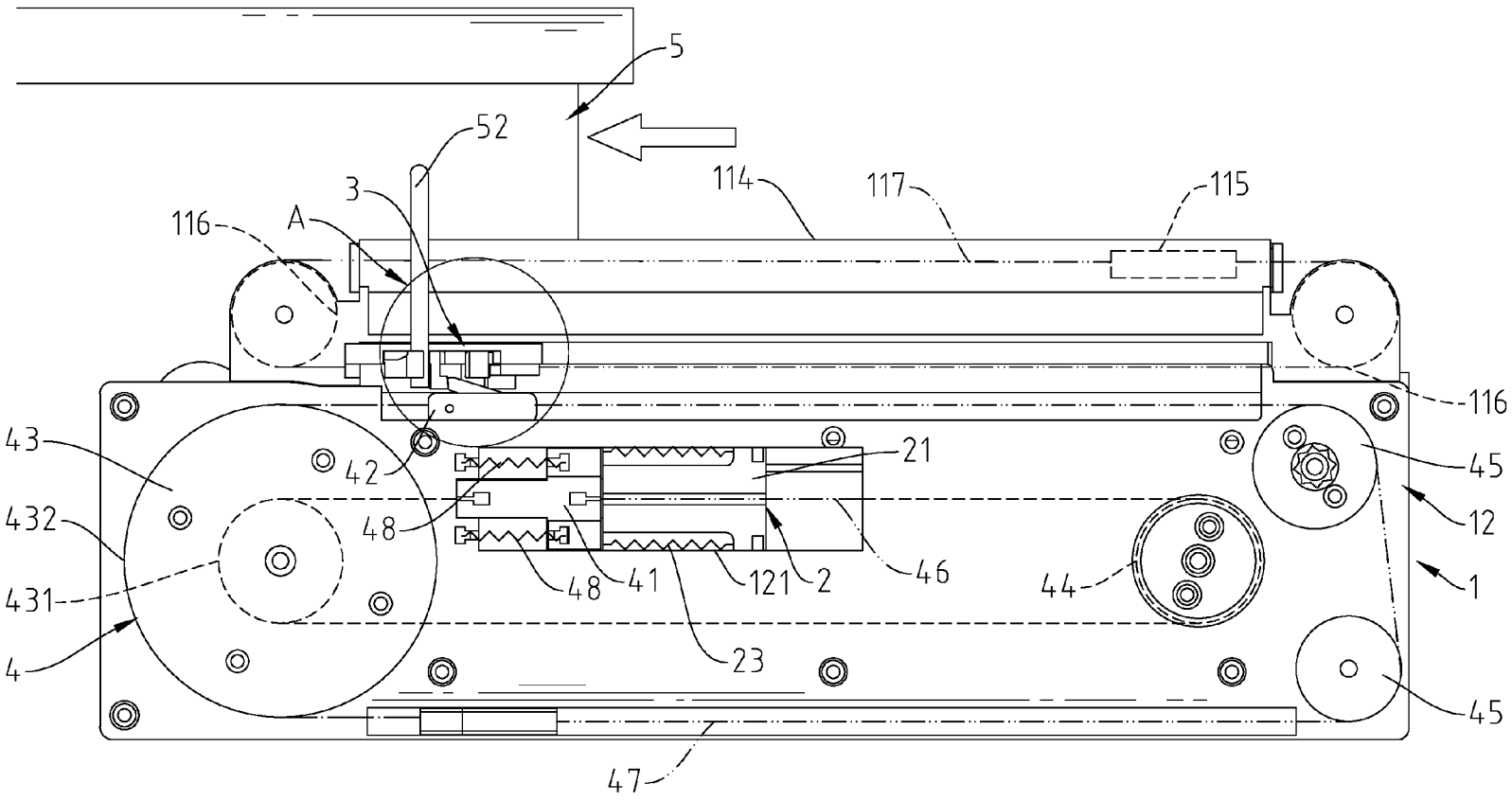
FIG. 12 is a schematic drawing illustrating an operation status of the automatic full-open type sliding box mounting structure in accordance with the present invention (VI).
Figure 13:
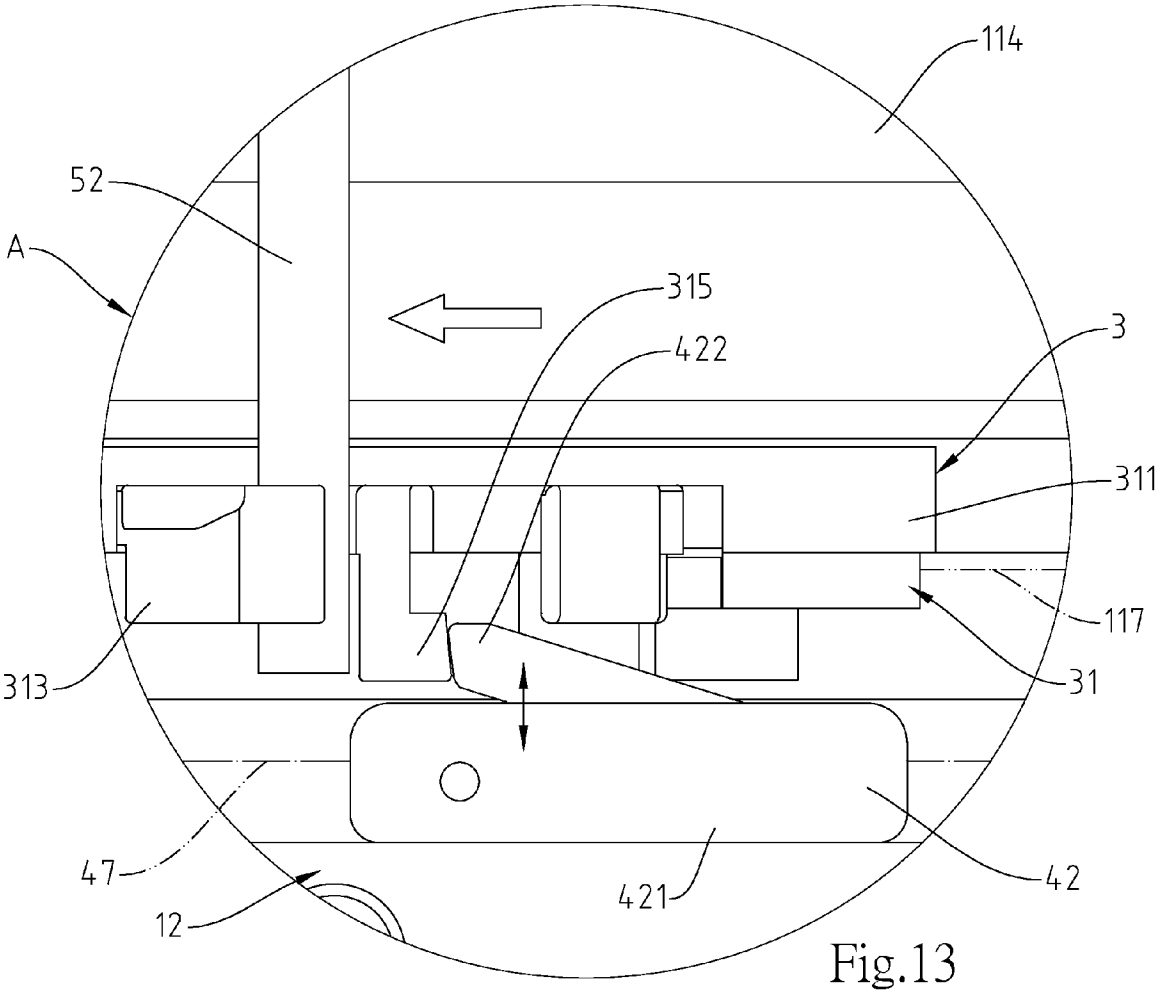
FIG. 13 is an enlarged view of part A of FIG. 12.
Figure 14:
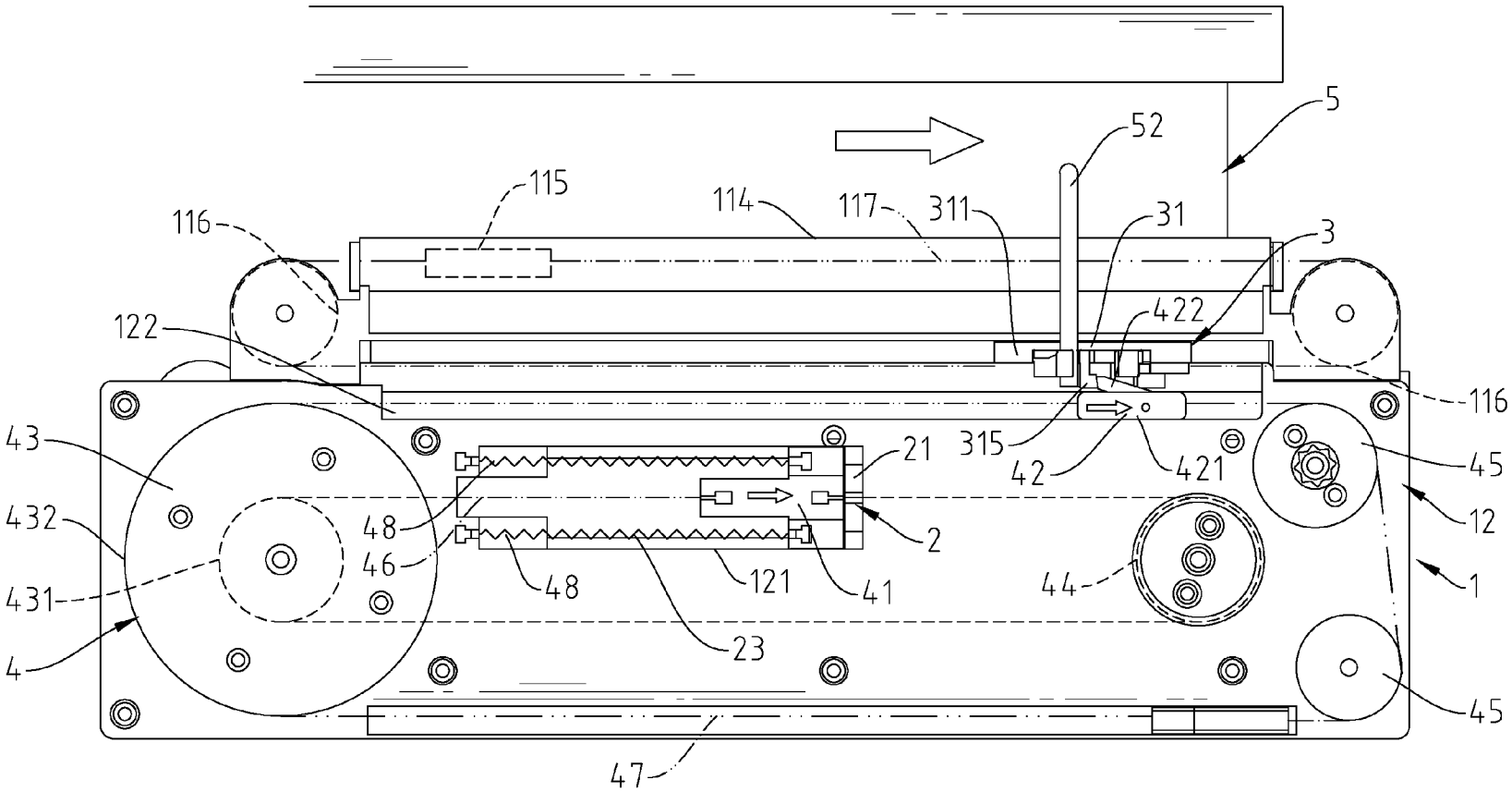
FIG. 14 is a schematic drawing illustrating an operation status of the automatic full-open type sliding box mounting structure in accordance with the present invention (VII).
Figure 15:
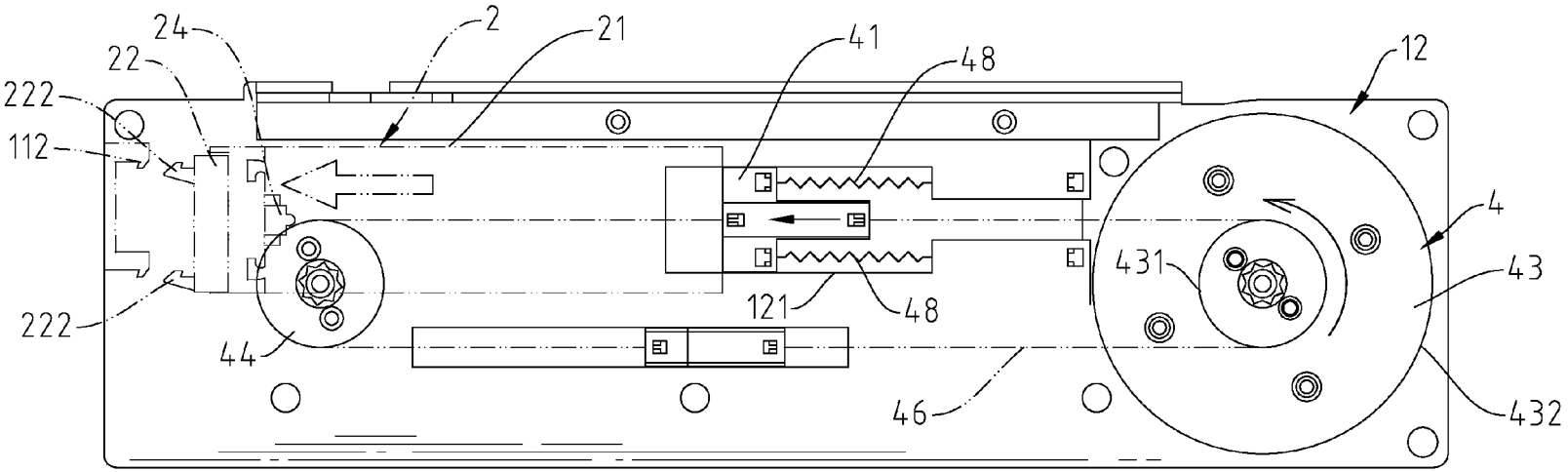
FIG. 15 is a schematic drawing illustrating an operation status of the automatic full-open type sliding box mounting structure in accordance with the present invention (VIII).
Figure 16:
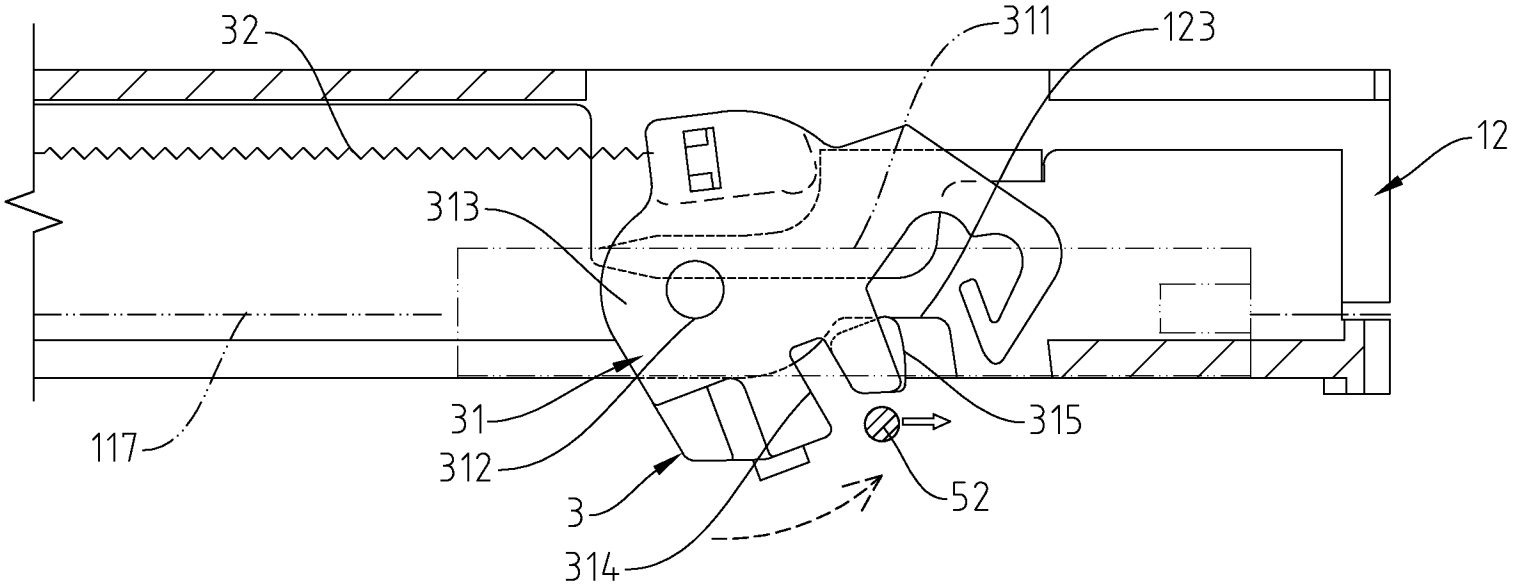
FIG. 16 is a schematic drawing illustrating an operation status of the automatic full-open type sliding box mounting structure in accordance with the present invention (IX).
Figure 17:
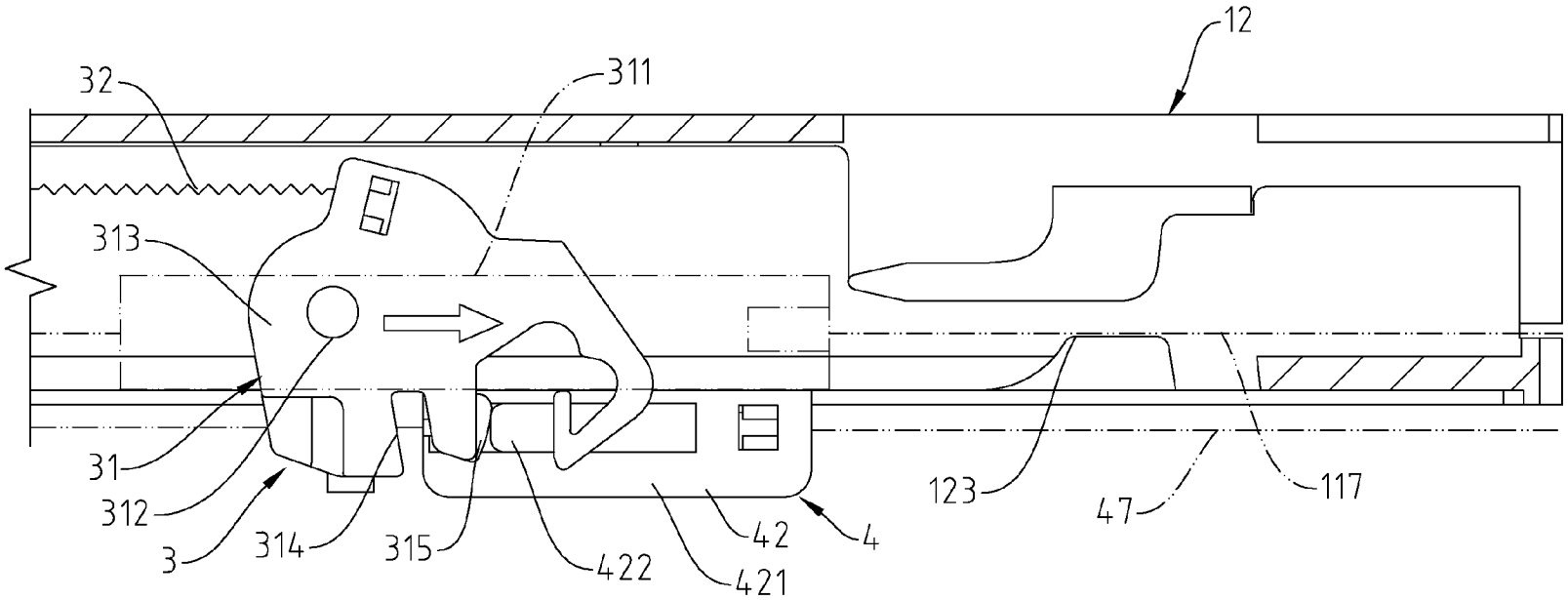
FIG. 17 is a schematic drawing illustrating an operation status of the automatic full-open type sliding box mounting structure in accordance with the present invention (X).
Figure 18:
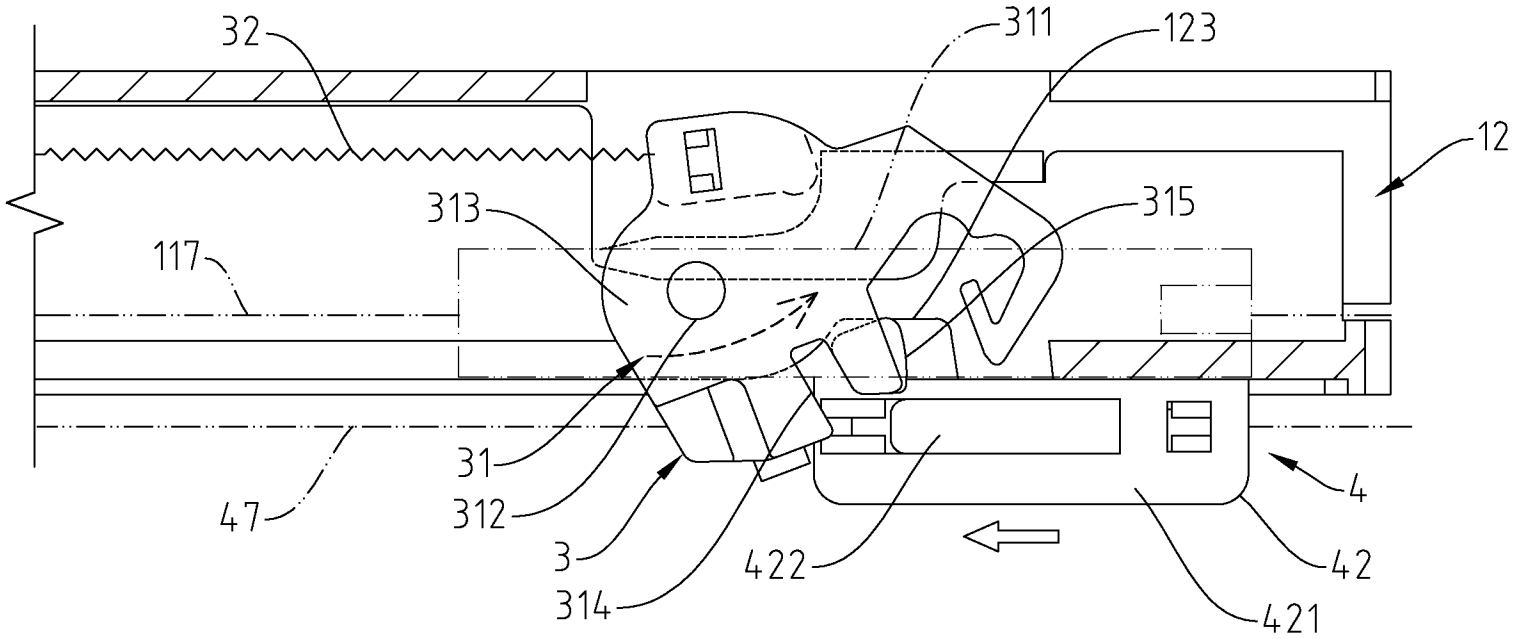
FIG. 18 is a schematic drawing illustrating an operation status of the automatic full-open type sliding box mounting structure in accordance with the present invention (XI).
Figure 19:
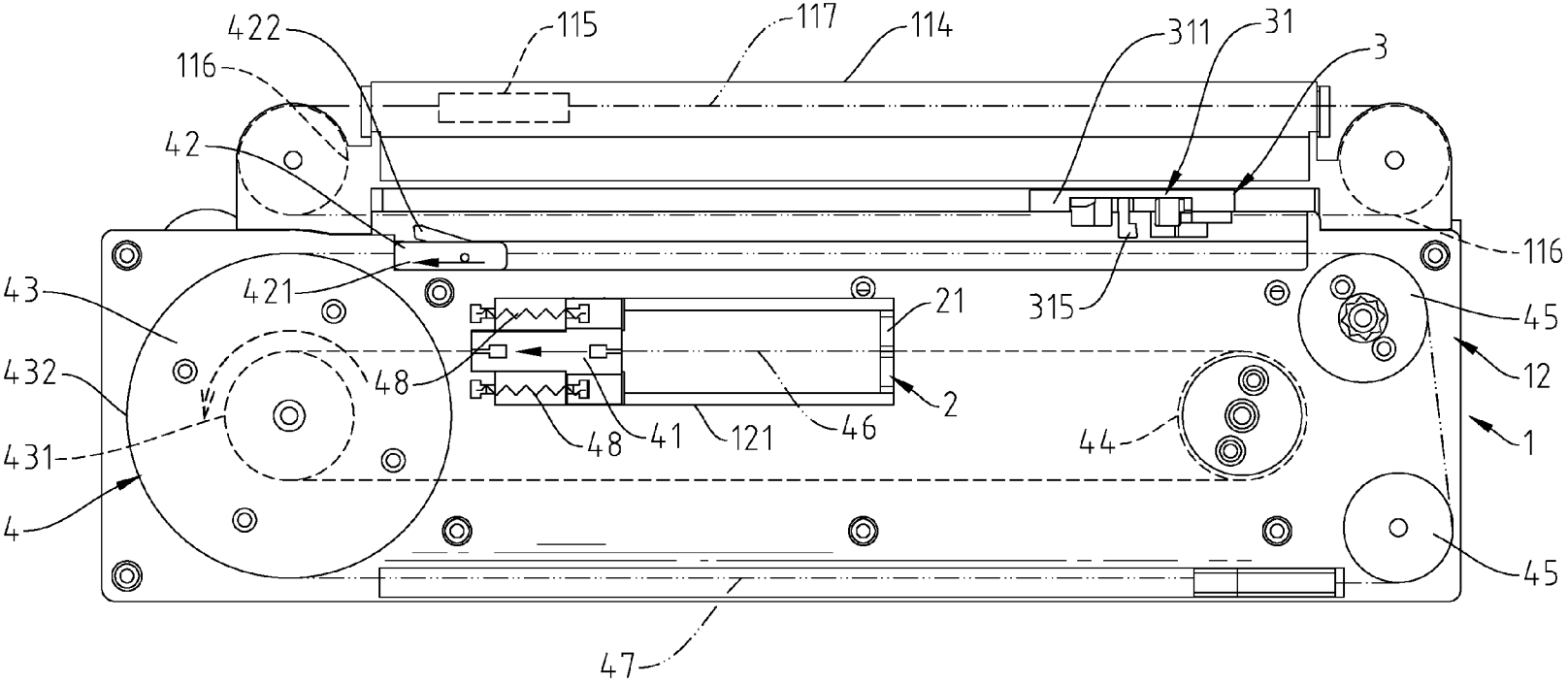
FIG. 19 is a schematic drawing illustrating an operation status of the automatic full-open type sliding box mounting structure in accordance with the present invention (XII).

Referring to FIGS. 4-8, when the user wishes to open the sliding box 5 from the close position shown in FIG. 6, push the press member 51 of the sliding box 5 to force the push block 24 against the stop rod 221 of the stop member 22, thereby biasing the stop rod 221 and causing the hook rods 222 to be disengaged from the stop block 112. After disengagement between the hook rods 222 and the stop block 112, the preserved elastic potential energy of the first elastic member 23 immediately pulls the first sliding member 21 and the sliding box 5 in direction away from the stop block 112. When the sliding box 5 is being moved in direction away from the stop block 112, as shown in FIGS. 9-11, the push rod 52 of the sliding box 5 will be moved toward the second sliding member 31 of the second opening and closing device 3 and then into the retaining notch 314 of the second sliding member 31 to bias the retaining plate 313 and to further move the protruding stop portion 315 out of the retaining hole 123. After disengagement of the protruding stop portion 315 from the retaining hole 123, the preserved elastic potential energy of the second elastic member 32 immediately pulls the second sliding member 31 in direction away from the stop block 112, thereby carrying the sliding box 5 to the full open position. Referring to FIGS. 12 and 13, when the sliding box 5 reaches the full open position, the protruding stop portion 315 of the second sliding member 31 will push the elastically retractable stop component 422 of the second push member 42 back to the inside of the body 421 and then pass over the elastically retractable stop component 422. After the protruding stop portion 315 passes over the elastically retractable stop component 422, the elastically retractable stop component 422 immediately extends to the outside of the body 421 again. Referring to FIGS. 14 and 15, when going to close the sliding box 5, push the sliding box 5 in direction toward the stop block 112. At this time, the push rod 52 of the sliding box 5 will push the second sliding member 31 in direction toward the stop block 112 and simultaneously force the second push member 42 to move the second transmission belt 47, causing the first transmission wheel 43 to carry the first push member 41 in moving the first sliding member 21 back to its former position and forcing the stop member 22 into engagement with the stop block 112. Because the two opposite ends of the third elastic member 48 are respectively connected to the first push member 41 and the second longitudinal sliding slot 121, the first push member 41 will be forced to push the first sliding member 21 back to its former position, letting the third elastic member 48 to return to its former shape. Referring to FIGS. 14-19, when the second sliding member 31 is carried by the push rod 52 to move the protruding stop portion 315 to the bottom side of the retaining hole 123 upon closing of the sliding box 5, the retaining plate 313 will be biased by the second elastic member 32, causing the protruding stop portion 315 to be forced into the retaining hole 123. At this time, the protruding stop portion 315 will be released from the constraint of the elastically retractable stop component 422 of the second push member 42. Immediately after the protruding stop portion 315 is released from the constraint of the elastically retractable stop component 422, the third elastic member 48 pulls the first push member 41 back to its former position, causing the first transmission wheel 43 to carry the second push member 42 back to its former position. Thus, one opening and closing cycle of the sliding box 5 is done.

Referring to FIGS. 9 and 14 again, when opening or closing the sliding box 5, the second sliding member 31 will carry the piston 115 to move in the damper 114, imparting a damping resistance to the second sliding member 31 and avoiding sliding box impact.

Referring to FIGS. 2 and 14 again, because the diameter of the first endless groove 431 of the first transmission wheel 43 is smaller than the diameter of the second endless groove 432, the second push member 42 will be forced to rotate the first transmission wheel 43 when closing the sliding box 5. Thus, the user can close the sliding box 5 to reset the first elastic member 23 and the second elastic member 32 with less effort.

In conclusion, the automatic full-open type sliding box mounting structure of the present invention has the features as follows:

1. The invention uses the first opening and closing device 2 and the second opening and closing device 3 to automatically open the sliding box 5 to the full open position in a two-stage manner, and the reset device 4 to let the sliding box 5 be closed and the first opening and closing device 2 and second opening and closing device 3 be returned to their former status, facilitating user operation without space constraints and minimizing the structure dimension.

2. The first endless groove 431 and second endless groove 432 of the first transmission wheel 43 of the reset device 4 have different diameters and are arranged in a concentric manner such that the user can easily drive the reset device 4 to reset the first opening and closing device 2 and the second opening and closing device 3, thereby closing the sliding box 5 accurately with less effort.

What the invention claimed is:

1. An automatic full-open type sliding box mounting structure, comprising: a sliding track assembly, a first opening and closing device, a second opening and closing device, and a reset device, wherein:

said sliding track assembly is mounted at a bottom side of said sliding box, comprising a first track member, said first track member comprising a first longitudinal sliding slot and a stop block located at one end thereof, a second track member slidably coupled to a bottom side of said first track member, said second track member comprising a second longitudinal sliding slot corresponding to said first longitudinal sliding slot, a third longitudinal sliding slot disposed in a parallel manner at one lateral side relative to said second longitudinal sliding slot and a retaining hole located at one lateral side thereof adjacent to said stop block of said first track member;

said first opening and closing device comprises a first sliding member slidably coupled to said first longitudinal sliding slot, a stop member connected to one end of said first sliding member and adapted for engaging said stop block, and a first elastic member, said first elastic member having one end thereof connected to an opposite end of said first sliding member remote from said stop member and an opposite end thereof connected to said second track member, said first elastic member being compressed to preserve an elastic potential energy when said stop member is engaged with said stop block;

said second opening and closing device comprises a second sliding member connected to one lateral side of said second track member and engageable into said retaining hole of said second track member and slidable in the same sliding direction of said first sliding member, and a second elastic member, said second elastic member having one end thereof connected to one end of said second sliding member and an opposite end thereof connected to said second track member, said second elastic member being compressed to preserve an elastic potential energy when said second sliding member is engaged into said retaining hole;

said reset device comprises a first push member set in said second longitudinal sliding slot, a second push member set in said third longitudinal sliding slot, a first transmission wheel pivotally mounted at one end of said second track member adjacent to one lateral side of said second longitudinal sliding slot, said first transmission wheel comprising a first endless groove and second endless groove extending around the periphery thereof, a second transmission wheel pivotally mounted at an opposite end of said second track member, a third transmission wheel pivotally mounted at the opposite end of said second track member adjacent to said second transmission wheel, a first transmission belt mounted around said first endless groove of said first transmission wheel and said second transmission wheel and connected with said first push member, and a second transmission belt mounted around said second endless groove of said first transmission wheel and said third transmission wheel and connected with said second push member.

2. The automatic full-open type sliding box mounting structure as claimed in claim 1, wherein said first track member further comprises at least one runner pivotally disposed adjacent to one end of said first longitudinal sliding slot remote from said stop block; said second elastic member is extended over said at least one runner and fixedly connected to said second track member.

3. The automatic full-open type sliding box mounting structure as claimed in claim 1, wherein said reset device further comprises a third elastic member, said third elastic member having two opposite ends thereof respectively connected to said first push member and one end of said second longitudinal sliding slot.

4. The automatic full-open type sliding box mounting structure as claimed in claim 1, wherein said stop member of said first opening and closing device comprises a middle stop rod and two opposing lateral hook rods for engagement with said stop block of said first track member; said first opening and closing device further comprises a push block disposed near said stop member of said first sliding member and adapted for pushing said stop member.

5. The automatic full-open type sliding box mounting structure as claimed in claim 1, wherein said second sliding member comprises a side frame coupled to and slidable along one lateral side of said second track member, a pivot mounted in said side frame, and a retaining plate pivotally mounted at said pivot, said retaining plate comprising a retaining notch located at a bottom side thereof and a protruding stop portion disposed adjacent to one lateral side of said retaining notch; said second elastic member is connected to said retaining plate adjacent to an opposite lateral side of said retaining notch.

6. The automatic full-open type sliding box mounting structure as claimed in claim 1, wherein said first track member further comprises a damper located at one lateral side thereof, a piston mounted in said damper, two fourth transmission wheels respectively pivotally disposed adjacent to two distal ends of said damper, and a third transmission belt mounted around said fourth transmission wheels and connected with said piston for moving said piston in said damper upon rotation.

7. The automatic full-open type sliding box mounting structure as claimed in claim 1, wherein said first track member further comprises a damper located at one lateral side thereof, a piston mounted in said damper, two fourth transmission wheels respectively pivotally disposed adjacent to two distal ends of said damper, and a third transmission belt mounted around said fourth transmission wheels; said second sliding member comprises a side frame coupled to and slidable along one lateral side of said second track member, a pivot mounted in said side frame, and a retaining plate pivotally mounted at said pivot and connected with said third transmission belt.

8. The automatic full-open type sliding box mounting structure as claimed in claim 1, wherein said second push member comprises a body, and an elastically retractable stop component mounted in said body and elastically movable in and out of said body.

9. The automatic full-open type sliding box mounting structure as claimed in claim 1, wherein the diameter of said first endless groove of said first transmission wheel is smaller than the diameter of said second endless groove, and said first endless groove and said second endless groove are disposed in a concentric manner.

* * * * *